US011587754B2

(12) United States Patent
Qian

(10) Patent No.: US 11,587,754 B2
(45) Date of Patent: Feb. 21, 2023

(54) ROTARY MAINTENANCE TYPE LEAKAGE PROTECTOR

(71) Applicant: YUYAO JIARONG ELECTRICAL APPLIANCE CO., LTD, Zhejiang (CN)

(72) Inventor: Jiacan Qian, Zhejiang (CN)

(73) Assignee: YUYAO JIARONG ELECTRICAL APPLIANCE CO., LTD, Zhejiang (CN)

( * ) Notice: Subject to any disclaimer, the term of this patent is extended or adjusted under 35 U.S.C. 154(b) by 0 days.

(21) Appl. No.: 17/531,823

(22) Filed: Nov. 22, 2021

(65) Prior Publication Data

US 2022/0328269 A1 Oct. 13, 2022

(30) Foreign Application Priority Data

Apr. 13, 2021 (CN) ..... 202110393561.2

(51) Int. Cl.
*H01H 73/44* (2006.01)
*H01H 71/24* (2006.01)

(52) U.S. Cl.
CPC ..... *H01H 71/2472* (2013.01); *H01H 71/2481* (2013.01); *H01H 73/44* (2013.01)

(58) Field of Classification Search
CPC ..... H01H 73/44; H01H 71/128; H01H 83/02
USPC ..... 335/18
See application file for complete search history.

(56) References Cited

U.S. PATENT DOCUMENTS 6,946,935 B2 * 9/2005 Wu ..... H01H 83/04 361/42
7,307,821 B2 * 12/2007 Wang ..... H01H 83/04 361/42
7,498,909 B2 * 3/2009 Zhang ..... H01H 83/04 335/34
7,859,368 B2 * 12/2010 Huang ..... H01H 83/04 335/6
8,222,978 B2 * 7/2012 Ku ..... H01H 83/02 335/177

* cited by examiner

*Primary Examiner* — Alexander Talpalatski
(74) *Attorney, Agent, or Firm* — Gang Yu

(57) ABSTRACT

Provided is a rotary maintenance type leakage protector which relates to a technical field of leakage protectors, and the rotary maintenance type leakage protector includes: a base, a leakage protection device, and an upper cover. The leakage protection device includes a reset key, a return rotation stopper, an electromagnetic driven device and an elastic piece, wherein the base is further provided with a conducting terminal that can be electrically connected with the elastic piece; each side of the return rotation stopper is provided with a protruding end that can be abutted against the elastic piece; the electromagnetic driven device is disposed on a side of an upper part of the base, and the electromagnetic driven device is provided with a driven iron core and can drive the driven iron core to move.

16 Claims, 12 Drawing Sheets

ROTARY MAINTENANCE TYPE LEAKAGE PROTECTOR

TECHNICAL FIELD

The present invention relates to a technical field of leakage protectors, and in particular to a rotary maintenance type leakage protector.

BACKGROUND

A leakage protector can disconnect a main wire in time when an apparatus has a leakage fault or there is a need to protect against a fatal personal electric shock, so that it is widely used. An application technology of the leakage protector has been very mature. From a protection principle, there are a voltage type and a current type. From a mechanical structure, there are a self-locking type and a suck type, and a current or voltage mechanical self-locking structure type of leakage protector is usually used. The biggest characteristic of the mechanical self-locking structure is: when power supply of the leakage protector in operation is interrupted, a power supply circuit thereof loses a phase, or a wire is poorly connected, the mechanical self-locking structure of the leakage protector in a closed state will not be able to actively disconnect a closed contact. At this time, if the power supply circuit is abnormally lacking the phase or a ground wire is abnormally charged or leaks, the leakage protector will lose its protection effect and cause a safety accident; furthermore, a buckle sheet of the existing leakage protector structure generally slides by using a surface contact method, so frictional force is large, which affects a service life of movable parts.

SUMMARY

In view of the above-mentioned problems, in the present invention, a self-release mode rotation structure is designed, which adopts a continuous power supply of coils to suck and a release mechanism. When the power supply is interrupted, the contact is poor, or the phase is lost, a suck maintenance circuit of the structure cannot generate magnetic force to suck the self-release structure as the circuit loses a voltage, resulting in disconnections of a release circuit and a closed contact to form an active protection, which eliminates safety hazards, reduces wear among parts, and increases the service life.

For example, a leakage protector disclosed in Chinese utility model patent CN211907362U includes: a protector device, a pin, a bottom plate and an elastic piece; the protector device includes a communication maintenance device, a communication device and a locking device; the locking device includes an elastic piece compression block and a locking lever; the locking lever is provide with a locking buckle, a movable compression plate and a buckle slide; the elastic piece compression block is provided with a compression bar, a buckle and a vertical fork groove; the communication device is provided with a second iron core protruding laterally, and the second iron core is in clamping fit with the vertical fork groove; the communication maintaining device is provided with a first iron core longitudinally fixed, the first iron core is sucked to the movable compression plate, and the elastic piece compression block includes an upper part and a lower part thereof; and, the structure of the leakage protector is more complicated and the volume is larger.

1. Technical Problems to be Solved

In view of the above-mentioned defects in the prior art, the present invention proposes a rotary maintenance type leakage protector, which solves a problem that the existing leakage protector has a complex structure and serious friction among parts thereof, and also solves a problem that the existing leakage protector can only break the circuit when it is powered on.

2. Technical Solutions

In order to solve the above technical problems, some embodiments of the present invention provide a rotary maintenance type leakage protector, includes: a base, a leakage protection device, wherein the leakage protection device comprises a reset key, a return rotation stopper, an electromagnetic driven device and an elastic piece; and an upper cover, wherein the base is further provided with a conducting terminal that is electrically connected with the elastic piece;

Wherein the return rotation stopper is mounted on an upper part of the base and is configured to move up and down, and two sides of the return rotation stoppers are provided with protruding ends that can be abutted against the elastic piece; the electromagnetic driven device is disposed on a side of the upper part of the base, and the electromagnetic driven device is provided with a driven iron core, the driven iron core is protruded from the electromagnetic driven device and is movably clamped to a side wall of the return rotation stopper, and the electromagnetic driven device is able to drive the driven iron core to move so as to drive the return rotation stopper to rotate;

the return rotation stopper is provided with a buckle block inwardly protruded, and the reset key is sleeved with a return spring, one end of the return spring is abutted against an upper part of the upper cover, the other end of the return spring is abutted against the reset key; the reset key passes through the upper cover and is inserted into the return rotation stopper, and the reset key drives the return rotation stopper to move synchronously by the buckle block; when the buckle block and the reset key are clamped, the reset key is pressed to make the return rotation stopper move down, while the elastic piece moves down accordingly, so that the elastic piece is separated from the conducting terminal and is therefore powered off; when the reset key is not pressed by external force, the reset key will reset and move up under the action of the return spring, and the return rotation stopper can drive the elastic piece to move up and is in contact with the conducting terminal, so the elastic piece is powered on;

the electromagnetic driven device in a continuous power-on state is configured to enable the driven iron core to continuously tighten the return rotation stopper, and enables the buckle block to be continuously clamped to the reset key; the reset key enables a power-on state in which the elastic piece is in contact with the conducting terminal through the return rotation stopper;

after the electromagnetic driven device in the continuous power-on state is powered off, the driven iron core releases the return rotation stopper, the buckle block and the reset key are out of a clamped state, and, the elastic piece is separated from the conducting terminal under an elastic force action of the elastic piece and is therefore powered off.

In some embodiments, the reset key is provided with a bayonet in clamping fit with the buckle block, and the bayonet is provided with an upper clamping surface and a lower tripping inclined surface.

In some embodiments, an opening groove is provided on a side wall, close to the driven iron core, of the return rotation stopper, the buckle block is provided on a side wall, opposite to the opening groove, of the return rotation stopper, and the opening groove is used for being clamped to the driven iron core.

In some embodiments, a top of the base is provided with a sliding groove which can enable the return rotation stopper to be inserted and installed up down into the base, the return rotation stopper is movable up and down relative to the sliding groove, and the return rotation stopper is rotatable in the sliding groove with the protruding ends as an axis.

In some embodiments, after the electromagnetic driven device is powered off, the driven iron core releases the return rotation stopper, the reset key moves upwards under an action of the return spring; during an upward movement of the reset key, the return rotation stopper slides out of the lower tripping inclined surface of the reset key and is out of a clamped state with regard to the reset key.

In some embodiments, the conducting terminal has a pin structure, wherein the pin structure includes a neutral wire pin, a live wire pin and a ground wire pin, the elastic piece includes a neutral wire elastic piece and a live wire elastic piece; a position of the neutral wire pin is corresponded to a position of the neutral wire elastic piece, a position of the live wire pin is corresponded to a position of the live wire elastic piece, and the ground wire pin is directly connected with a ground wire; two protruding ends are provided at lower parts of the neutral wire elastic piece and the live wire elastic piece, and the neutral wire elastic piece and the live wire elastic piece both automatically moves downward under the action of their own elastic force.

In some embodiments, the conducting terminal has a pin structure, the pin structure includes a neutral wire pin, a live wire pin and a ground wire pin, the elastic piece includes a neutral wire elastic piece, a live wire elastic piece and a ground wire elastic piece; a position of the neutral wire pin is corresponded to a position of the neutral wire elastic piece, a position of the live wire pin is corresponded to a position of the live wire elastic piece, and a position of the ground wire pin is corresponded to a position of the ground wire elastic piece; two protruding ends are disposed at lower parts of the neutral wire elastic piece and the live wire elastic piece, and the neutral wire elastic piece and the live wire elastic piece both automatically move downward under action of their own elastic force; a bottom of the return rotation stopper is provided with a ground wire protruding end, and the ground wire protruding end is provided on a top of the ground wire elastic piece for controlling the ground wire elastic piece to move downward; the ground wire elastic piece automatically moves upward under an action of its own elastic force.

In some embodiments, the leakage protection device further includes a compression guide block disposed on a side of the upper part of the base by clamping, and the compression guide block is provided with a compression end for compressing and fixing the conducting terminal on the base.

In some embodiments, the conducting terminal and the elastic piece are embedded in the base; both the conducting terminal and the elastic piece are provided with corresponding conducting contacts; an end of the return rotation stopper is further provided with an indicator rod that is protruded, the indicator rod is able to rotate with the return rotation stopper so as to display a status of the leakage protector.

In some embodiments, a bottom of the reset key passes through the return rotation stopper; the base is provided with a jack corresponding to the bottom of the reset key.

In some embodiments, a bottom of the reset key passes through the return rotation stopper and the ground wire elastic piece; the base is provided with a jack corresponding to the bottom of the reset key.

In some embodiments, an auxiliary ground wire return spring is provided between the ground wire elastic piece and the base.

In some embodiments, an auxiliary tripping spring is provided between the bottom of the reset key and a bottom of the return rotation stopper.

In some embodiments, the ground wire protruding end can enable the neutral wire elastic piece and the live wire elastic piece to be disconnected prior to the ground wire elastic piece.

In some embodiments, a side part of the reset key is further provided with a return sliding groove, and the return rotation stopper is further provided with a sliding guide post, and the return sliding groove can correspondingly engage with the sliding guide post.

In some embodiments, an upper part of the return sliding groove is provided with a sliding groove transition inclined surface, and during a compression of the reset key, the sliding guide post firstly slides in cooperation with the return groove, and then slides out of the sliding groove transition inclined surface and is abutted against a side surface of the reset key, so that the return rotation stopper rotates towards a side of the electromagnetic driven device.

3. Beneficial Effects

Compared with the prior art, the rotary maintenance type leakage protector provided in the present invention maintains the closed state of the leakage protector by continuously supplying power to the electromagnetic driven device for sucking and clamping. When it happens in the leakage protector that the power supply is interrupted, the contact is poor, or the phase is lost, the electromagnetic driven device cannot produce the magnetic force due to the loss of voltage, so that the clamping structure of the bayonet and the return rotation stopper are not clamped, so the reset key and the reset stopper are in the separated state in which they are unable to move together. Therefore, the leakage protector is separated and powered off, thereby forming the active protection and eliminating safety hazards.

At the same time, through the arrangement of the rotatable return rotation stopper, the wear among the parts is effectively reduced, and the service life is improved. Meanwhile, the overall sensitivity of the mechanism is greatly improved.

At the same time, through the arrangement of the auxiliary tripping spring, when the electromagnetic driven device is in the power-off state, the return rotation stopper can move downward under the action of the elastic force of the auxiliary tripping spring, so as to ensure that the elastic piece moves downward and is separated from the conducting terminal and is therefore powered off.

Figure 1:
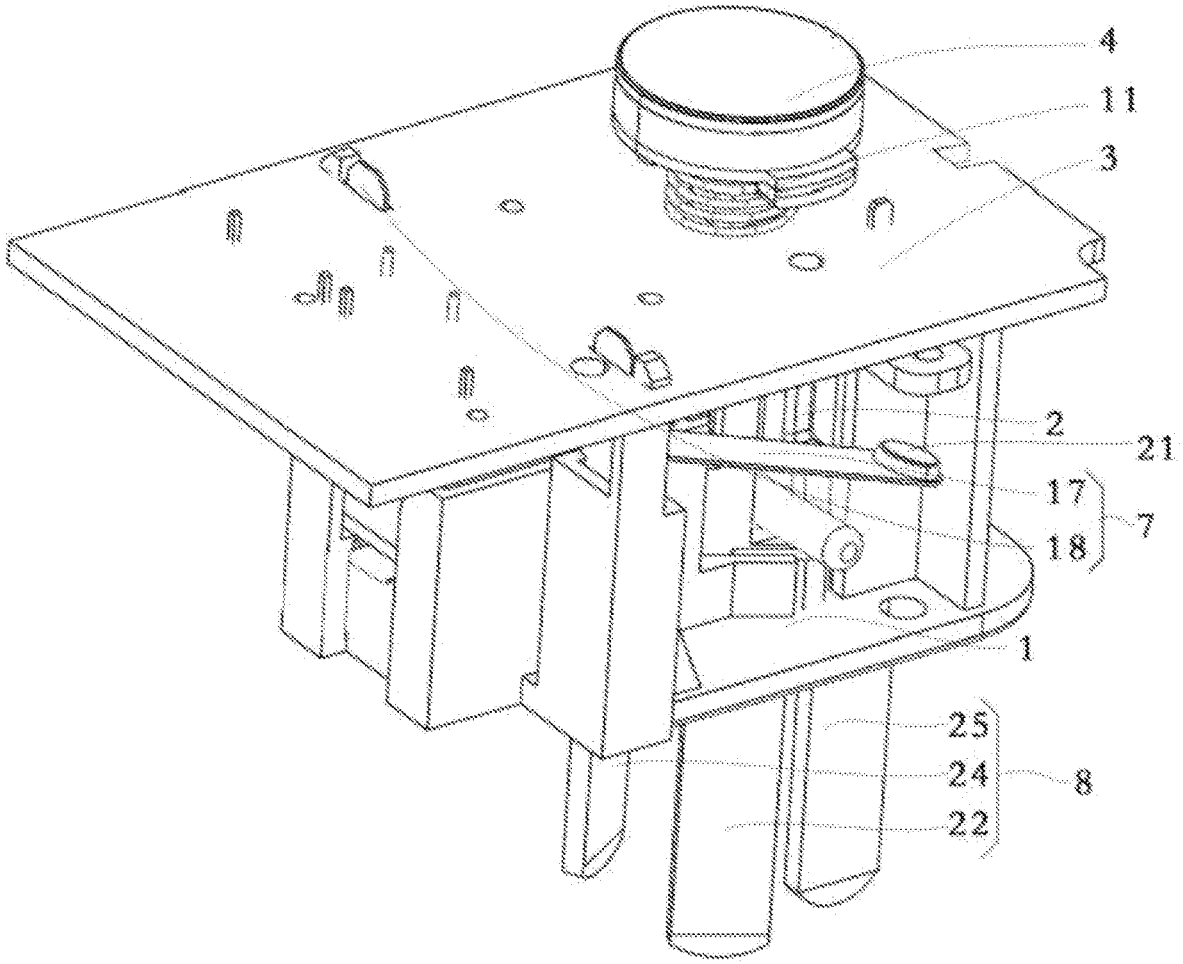
FIG. 1 illustrates a perspective diagram of a disconnected state of a leakage protector in the present invention.

In the figures: 1, base; 2, leakage protection device; 3, upper cover; 4, reset key; 5, return rotation stopper; 6, electromagnetic driven device; 7, elastic piece; 8, conducting terminal; 9, key button; 10, key bar; 11, return spring; 12, bayonet; 13, opening groove; 14, indicator rod; 15, protruding ends; 16, buckle block; 17, neutral wire elastic piece; 18, live wire elastic piece; 19, lower tripping inclined surface; 20, upper clamping surface; 21, conducting contact; 22, neutral wire pin; 23, driven iron core; 24, live wire pin; 25, ground wire pin; 26, sliding groove; 27, electromagnetic coil; 29, sliding guide post; 30, auxiliary tripping spring; 31, jack; 32, ground wire protruding end; 33, static iron core; 34, ground wire elastic piece; 35, return sliding groove; 36, sliding groove transition inclined surface; 37, auxiliary ground wire return spring; and, 38, elastic piece hole.

DETAILED DESCRIPTION OF THE EMBODIMENTS

The specific implementations of the present invention will be described in further detail below in conjunction with the accompanying drawings and embodiments.

The following embodiments are used to illustrate the present invention, but cannot be used to limit the scope of the present invention.

Embodiment 1

Figure 2:
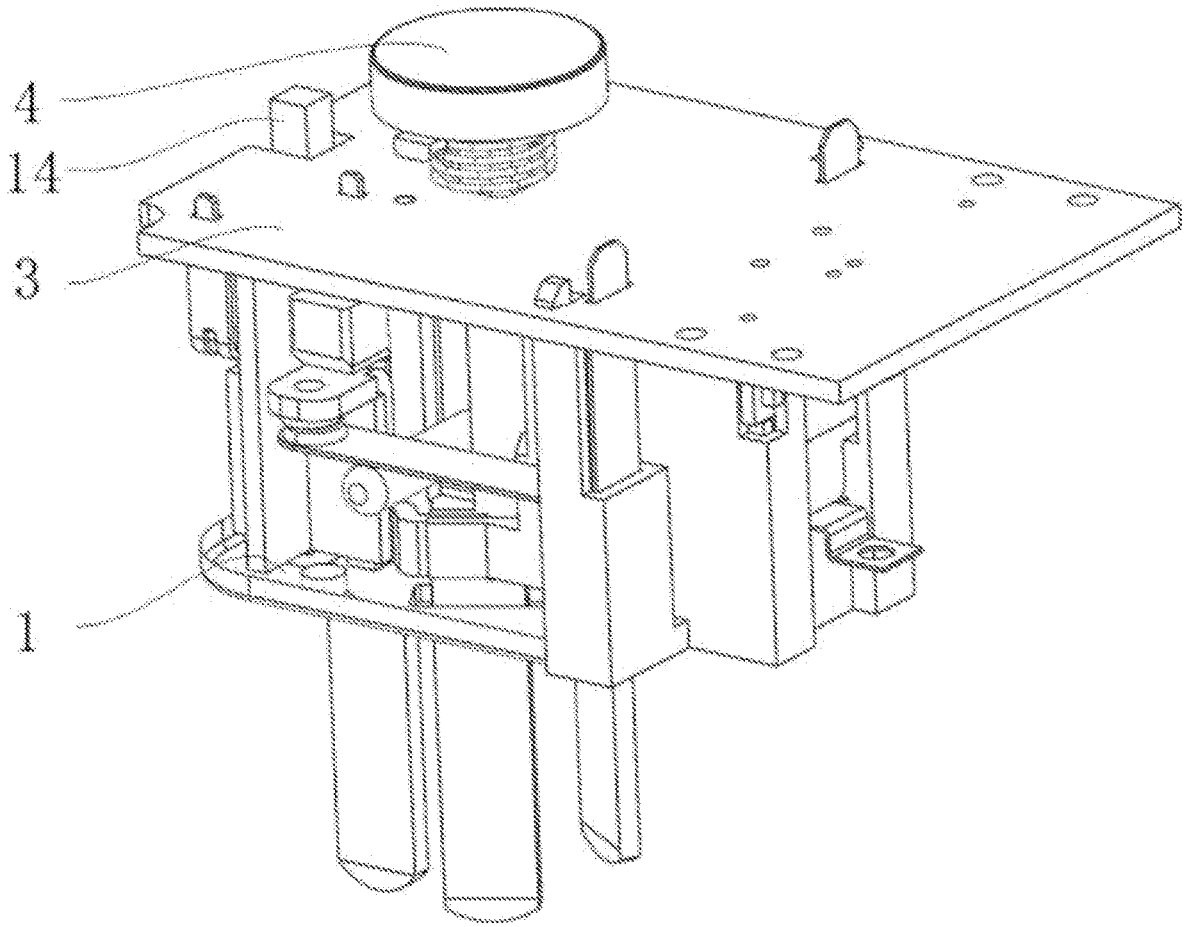
FIG. 2 illustrates a perspective diagram of a closed state of the leakage protector in the present invention.
Figure 4:
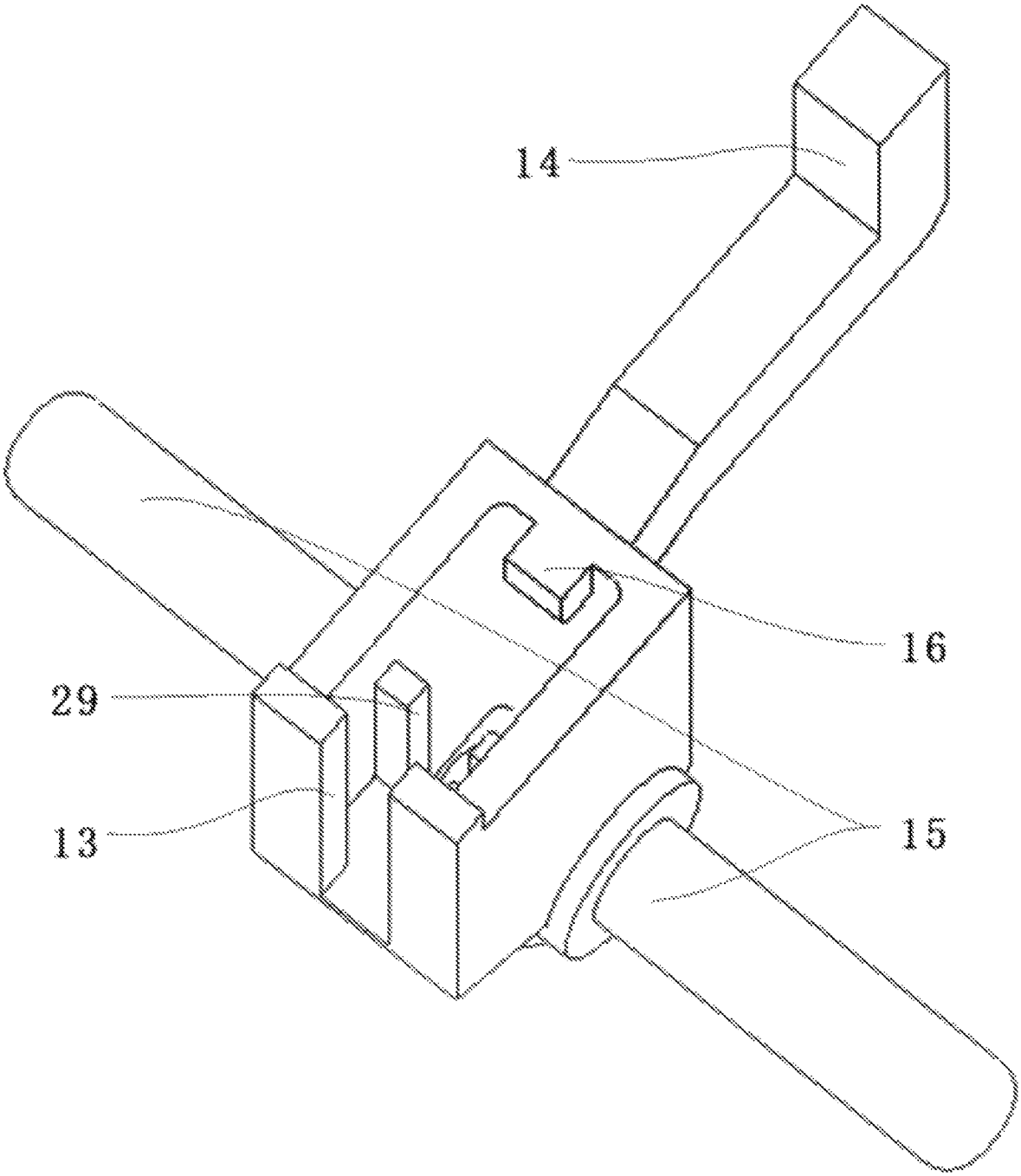
FIG. 4 illustrates a perspective diagram of a return rotation stopper of the leakage protector in the present invention.
Figure 5:
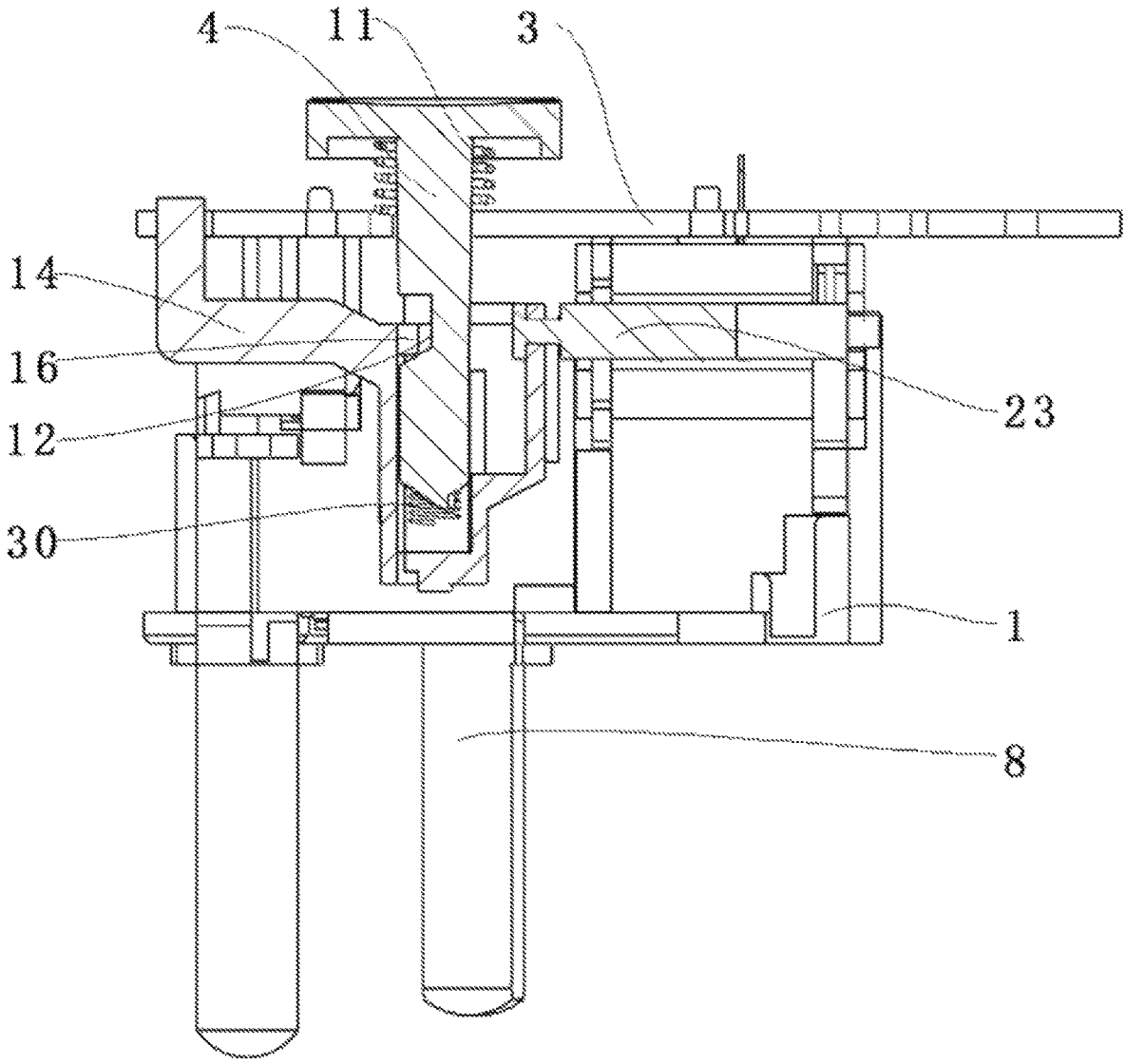
FIG. 5 illustrates a cross-sectional diagram of the leakage protector in the present invention.
Figure 6:
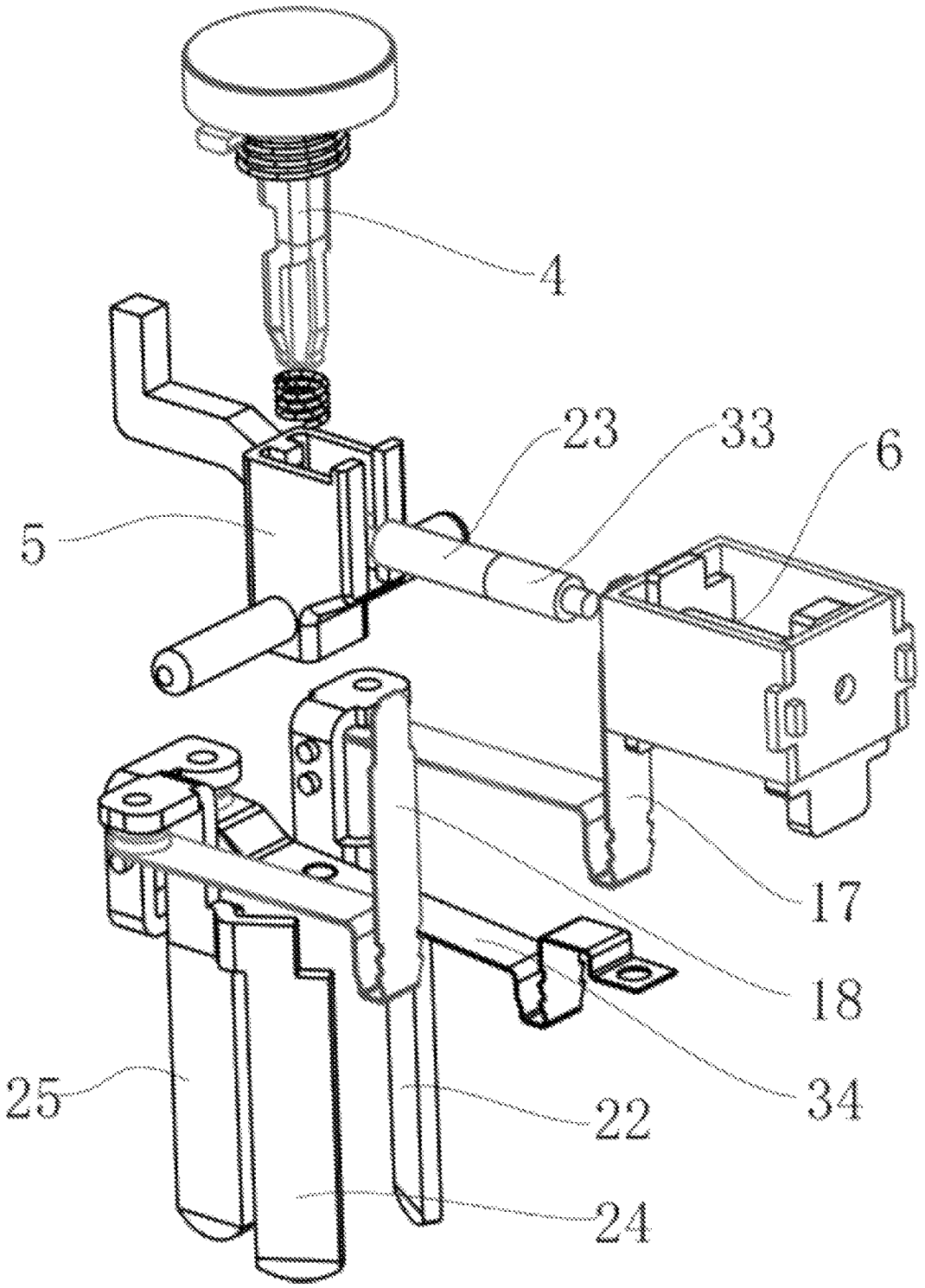
FIG. 6 illustrates an internal structural diagram 1 in which a ground wire elastic piece exists in the present invention.

A rotary maintenance type leakage protector according to an embodiment of the present invention, as shown in FIG. 1-FIG. 9, includes: a base 1, a leakage protection device 2, wherein the leakage protection device 2 includes a reset key 4, a return rotation stopper 5, an electromagnetic driven device 6 and an elastic piece 7; and an upper cover 3, the base 1 is further provided with a conducting terminal 8 that is electrically connected with the elastic piece 7; in this embodiment, the upper cover 3 can utilize a plastic partition or other material partitions which only play a role of supporting the following return spring 11, or utilize a circuit board which plays the same role; the leakage protection device 2 also includes a compression guide block, which is clamped and disposed on an upper side of the base 1; the compression guide block is positioned and fixed by a clamping groove correspondingly disposed in the base 1, and the compression guide block is provided with a compression end for pressing and fixing the conducting terminal 8 on the base 1;

the return rotation stopper 5 is mounted on an upper part of the base 1 and is configured to move up and down; the top of the base 1 is provided with a sliding groove 26 which can enable the return rotation stopper 5 to be inserted and installed up down into the base 1; the return rotation stopper 5 is clamped to the sliding groove 26 through protruding ends 15 on both sides of the return rotation stopper 5; the return rotation stopper 5 which is cylindrical is rotatable in the sliding groove 26 by using the protruding ends 15 as an axis, and controls contact and separation of the elastic piece 7 and the conducting terminal 8, that is, power-on and power-off of the leakage protector, through up and down movement of the protruding ends 15;

the electromagnetic driven device 6 is disposed on a side of the upper part of the base 1 and provided with a driven iron core 23 which is movable; a protruding end of the driven iron core 23 is movably clamped to a side wall of the return rotation stopper 5, as shown in FIG. 4, FIG. 5 and FIG. 6; an opening groove 13 is provided on a side wall of the return rotation stopper 5 close to the driven iron core 23; a buckle block 16 is arranged on a side wall opposite to the opening groove 13; the opening groove 13 is configured to be clamped to the driven iron core 23; when the electromagnetic driven device 6 is powered on, as shown in FIG. 2 and FIG. 5, the driven iron core 23 is sucked and tightened by a static iron core 33 inside the electromagnetic driven device 6;

the reset key 4 includes a key button 9 and a key bar 10, as shown in FIG. 1, the key bar 10 is sleeved with the return spring 11; one end of the return spring 11 is abutted against an upper part of the upper cover 3, and another end of the return spring 11 is abutted against the reset key 4; the reset key 4 passes through the upper cover 3 and is inserted into the return rotation stopper 5; the key bar 10 is provided with a bayonet 12 in clamping fit with the buckle block 16, and the bayonet 12 is provided with an upper clamping surface 20 and a lower tripping inclined surface 19, wherein the bayonet 12 is shaped like a "7" shaped opening;

when the leakage protector is in an initial state without electricity, the electromagnetic driven device 6 does not work, and the driven iron core 23 is in a free state without magnetic suck, and has no force restriction on the return rotation stopper 5; the buckle block 16 of the return rotation stopper 5 and the reset key 4 are out of a clamped state, and the elastic piece 7 is separated from the conducting terminal 8 under the action of its own elastic force; at this time, pressing the reset key 4 to compress the return spring 11 or the reset key 4 to return upward will not drive the return rotation stopper 5 to move;

when the leakage protector is powered on, as shown in FIG. 5, the electromagnetic driven device 6 is in a continuous power-on state to produce magnetic force and sucks the driven iron core 23; the return rotation stopper 5 is continuously tightened by the driven iron core 23; at this time, the buckle block 16 and the bayonet 12 remain clamped, and in this state, the up and down movement of the reset key 4 will also synchronously drive the return rotation stopper 5 to move;

when the leakage protector is powered off, that is, when the leakage protector encounters unexpected situations such as power interruption, poor contact, loss of phase, leakage, etc., the electromagnetic driven device 6 is powered off, and the driven iron core 23 releases the return rotation stopper 5; the buckle block 16 of the return rotation stopper 5 and the set key 4 are out of the clamped state, and the elastic piece 7 is separated from the conducting terminal 8 under the action of its own elastic force; at this time, the return spring 11 drives the reset key 4 to return upward.

In some embodiments, the reset key 4 would move upward under an action of the return spring 11; during an upward movement of the reset key 4, the return rotation stopper 5 loses pulling force exerted by the driven iron core 23, and the buckle block 16 will slide out along the lower tripping inclined surface 19 of the reset key 4 and is out of the clamped state with regard to the reset key 4; in this state, the reset key 4 and the return rotation stopper 5 are in a separated state; at this time, the elastic piece 7 drives, under the action of its own elastic force, the return rotation stopper 5 to move downward and is separated from the conducting terminal 8 and is therefore powered off.

The larger the inclination angle of the lower tripping inclined surface 19 is, the easier it is for the buckle block 16 to slide out of the lower tripping inclined surface 19. Therefore, the greater the inclination angle, the greater the required maintenance force of the driven core 23, wherein the inclination angle is defined as an acute angle between the lower tripping inclined surface 19 and the horizontal plane.

In this embodiment, through the above-mentioned structure design, the electromagnetic driven device 6 is continuously powered for being sucked and clamped, so that when the leakage protector encounters the power interruption, the poor contact, the loss of phase, or the current leakage, the electromagnetic driven device 6 cannot produce the magnetic force due to the loss of voltage. Therefore, the clamping structure of the bayonet 12 and the buckle block 16 is not clamped, so that the reset key 4 and the return rotation stopper 5 are in a separated state, so the leakage protector is separated and powered off to form an active type protection to eliminate safety hazards.

Figure 8:
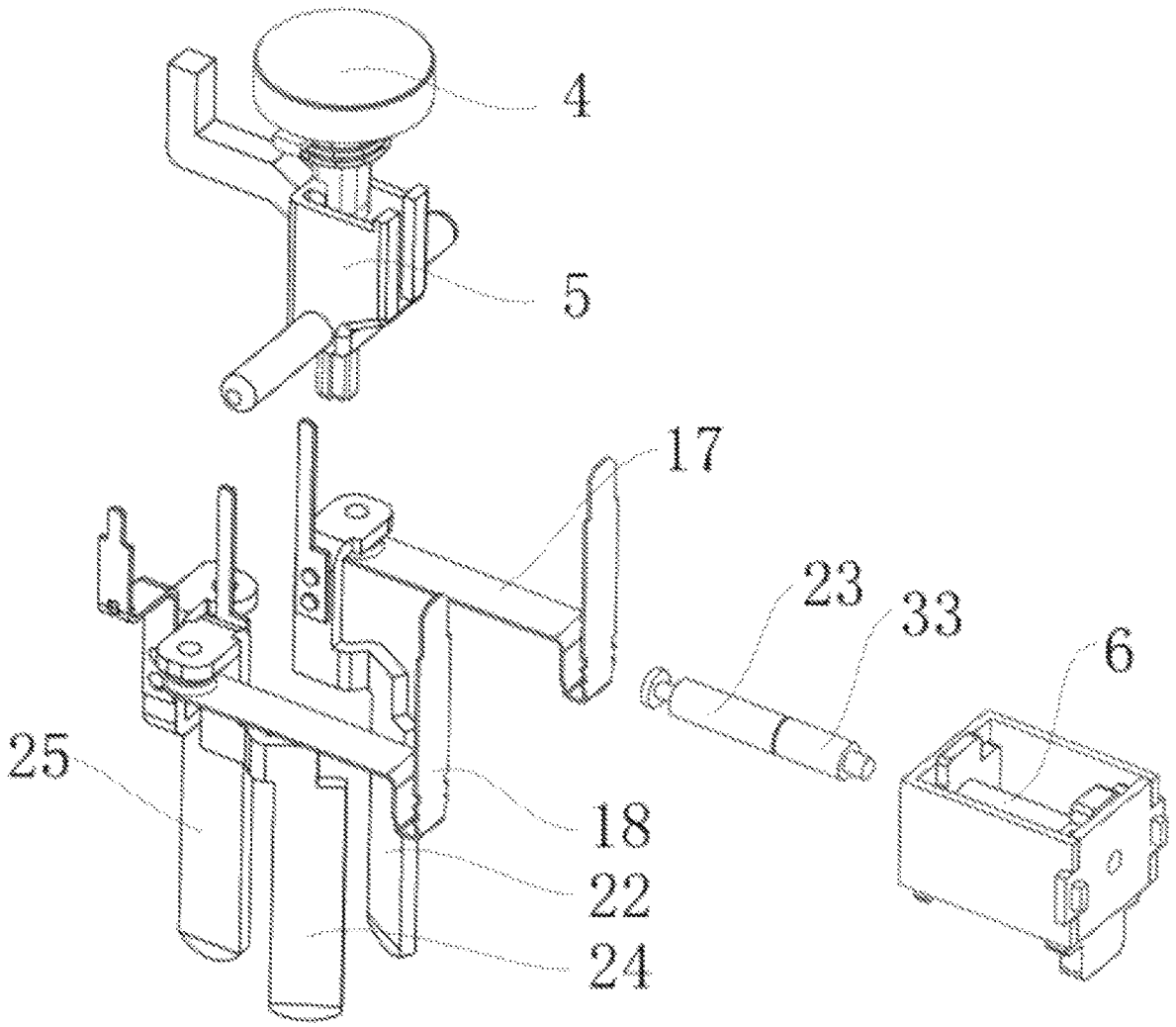
FIG. 8 illustrates an internal structural diagram 1 in which the ground wire elastic piece does not exist in the present invention.
Figure 9:
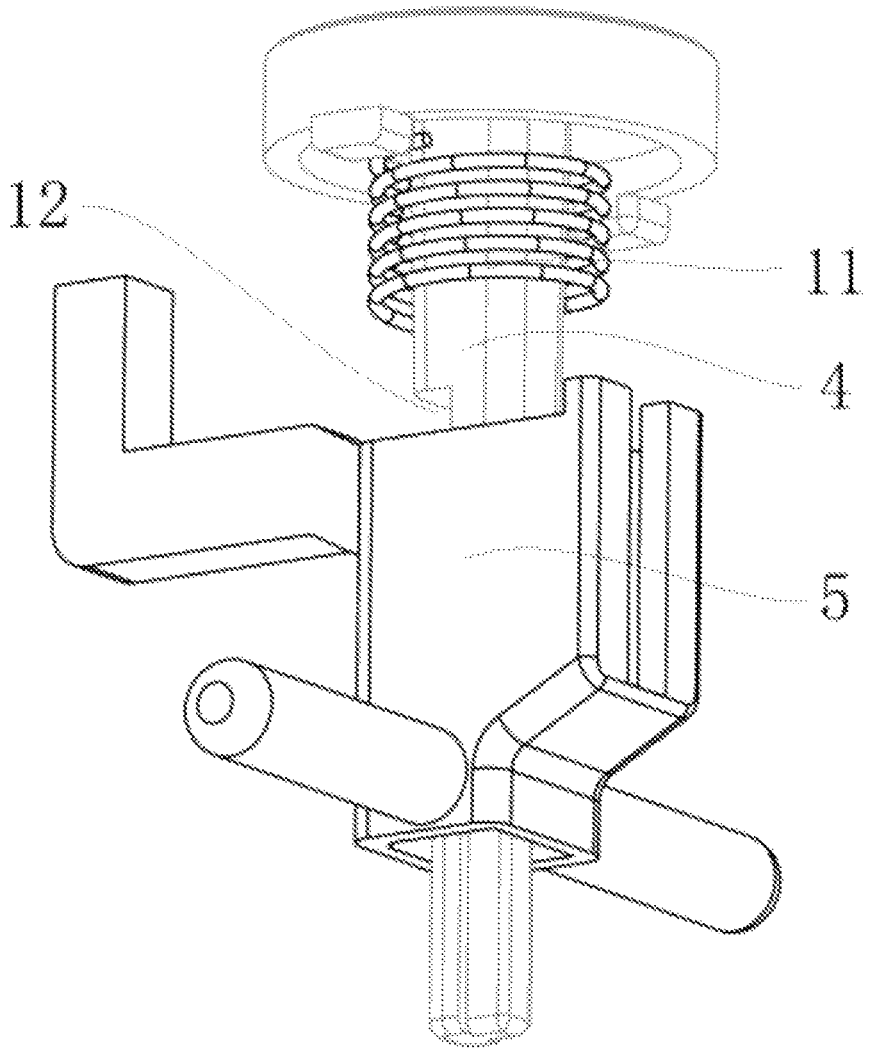
FIG. 9 illustrates an internal structural diagram 2 in which the ground wire elastic piece does not exist in the present invention.

As shown in FIG. 8 and FIG. 9, the conducting terminal 8 has a pin structure, the pin structure includes a neutral wire pin 22, a live wire pin 24, and a ground wire pin 25. The elastic piece 7 includes a neutral wire elastic piece 17 and a live wire elastic piece 18. A position of the neutral wire pin 22 is corresponded to a position of the neutral wire elastic piece 17. A position of the live wire elastic piece 18 is corresponded to a position of the live wire pin 24, and the ground wire pin 25 is directly is connected with a ground wire. Two protruding ends 15 are provided at a lower part of the neutral wire elastic piece 17 and the live wire elastic piece 18. Both of the neutral wire elastic piece 17 and the live wire elastic piece 18 automatically move downward under the action of their own elastic force. Both of the conducting terminal 8 and the elastic piece 7 are provided with corresponding conducting contacts 21, which can be used to ensure the stability and reliability of the conducting.

This embodiment can achieve the effect of two-pole disconnection, that is, the neutral wire pin 22 is corresponded to the neutral wire elastic piece 17, and the live wire pin 24 is corresponded to the live wire elastic piece 18. The two-pole disconnection means that the return rotation stopper 5 controls connection and disconnection of the neutral wire pin 22 and the neutral wire elastic piece 17, and connection and disconnection of the live wire pin 24 and the live wire elastic piece 18.

Embodiment 2

Figure 7:
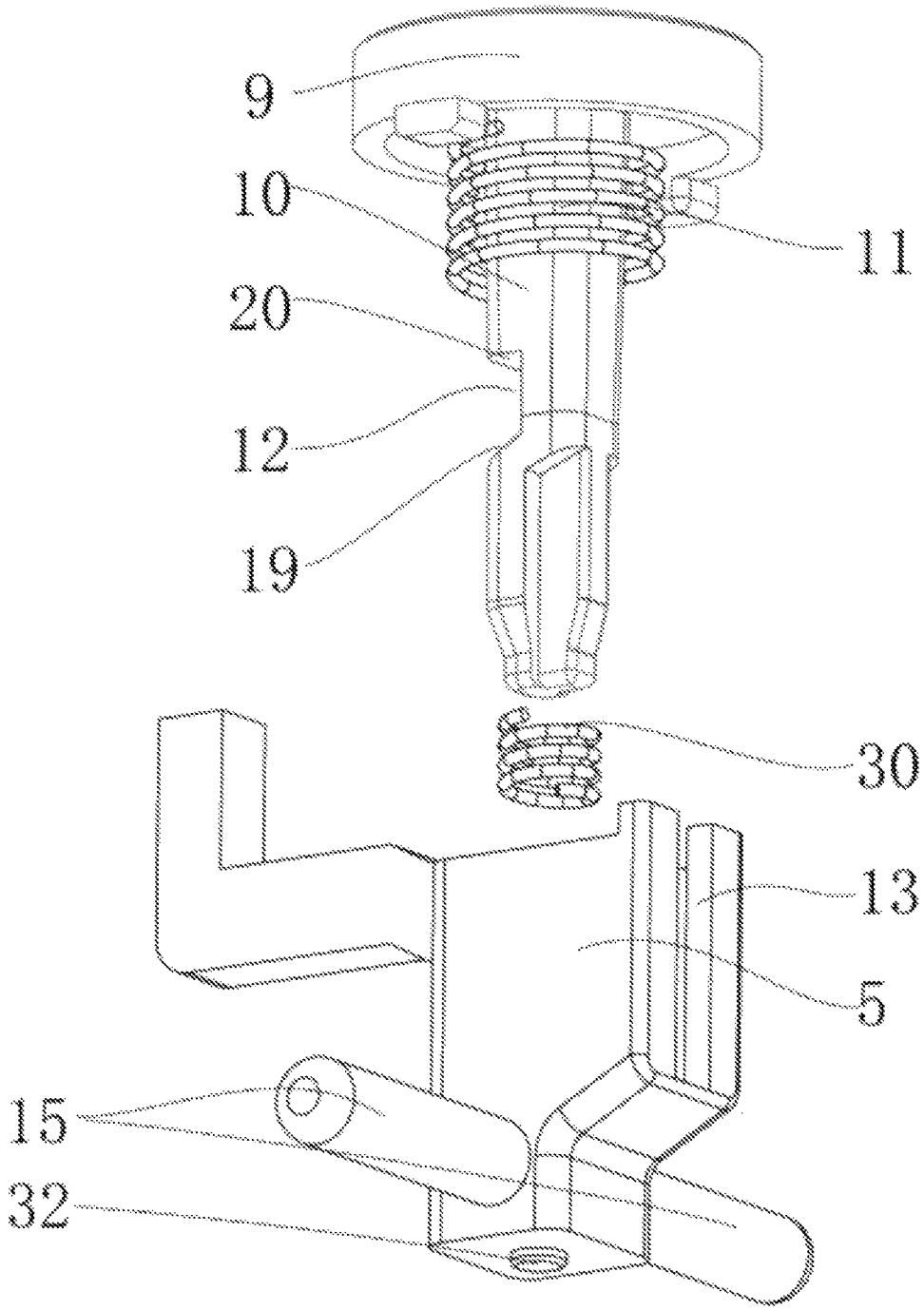
FIG. 7 illustrates an internal structural diagram 2 in which the ground wire elastic piece exists in the present invention.

Compared with embodiment 1, in this embodiment, as shown in FIG. 6 and FIG. 7, the conducting terminal 8 is the pin structure, the pin structure includes the neutral wire pin 22, the live wire pin 24, and the ground wire pin 25. The elastic piece 7 includes the neutral wire elastic piece 17, the live wire elastic piece 18 and the ground wire elastic piece 34. The position of the neutral wire pin 22 is corresponded to the position of the neutral wire elastic piece 17, and the position of the live wire pin 24 is corresponded to the position of the live wire elastic piece 18, and the position of the ground wire pin 25 is corresponded to the position of the ground wire elastic piece 34. Two protruding ends 15 are disposed at the lower part of the neutral wire elastic piece 17 and the live wire elastic piece 18. Both of the neutral wire elastic piece 17 and the live wire elastic piece 18 automatically move downward under the action of their own elastic force. A bottom of the return rotation stopper 5 is provided with a ground wire protruding end 32. The ground wire protruding end 32 is provided on a top of the ground wire elastic piece 34 to control the ground wire elastic piece 34 to move down, and the ground wire elastic piece 34 automatically moves upward under the action of its own elastic force. Both of the conducting terminal 8 and the elastic piece 7 are provided with corresponding conducting contacts 21, which can be used to ensure the stability and reliability of the conducting.

This embodiment can achieve the effect of three-pole disconnection, that is, the ground wire pin 25 is corresponded to the ground wire elastic piece 34, the neutral wire pin 22 is corresponded to the neutral wire elastic piece 17, and the live wire pin 24 is corresponded to the live wire elastic piece 18. The three-pole disconnection means that connection and disconnection of the aforementioned three can be controlled, wherein the return rotation stopper 5 controls the connection and disconnection of the neutral wire pin 22 and the neutral wire elastic piece 17, the connection and disconnection of the live wire pin 24 and the live wire elastic piece 18, and the connection and disconnection of the ground wire pin 25 and the ground wire elastic piece 34 at the same time.

In some embodiments, a boss is provided at a bottom of the ground wire protruding end 32. When the leakage protector is powered off, the arrangement of the boss can enable the neutral wire elastic piece 17 and the live wire elastic piece 18 to be disconnected before the ground wire elastic piece 34.

Embodiment 3

As shown in FIG. 1 and FIG. 2, compared to embodiment 1, the conducting terminal 8 and the elastic piece 7 are embedded on the base 1. The return rotation stopper 5 is further provided with a protruding indicator rod 14 at one end. The indicator rod 14 is able to rotate with the return rotation stopper 5, so as to display the status of the leakage protector. Specifically, a top of the indicator rod 14 is painted in red. When the leakage protector is in the power-on state, the bayonet 12 and the buckle block 16 remain in the clamping fit state, as shown in FIG. 2, that is, at this time, the red on the top of the indicator rod 14 can be seen at an observation window on a shell of the leakage protector, which serves as an indication. When the leakage protector is in the power-off state, as shown in FIG. 1, at this time, the red on the top of the indicator rod 14 cannot be seen at the observation window on the shell of the leakage protector.

Embodiment 4

Figure 12:
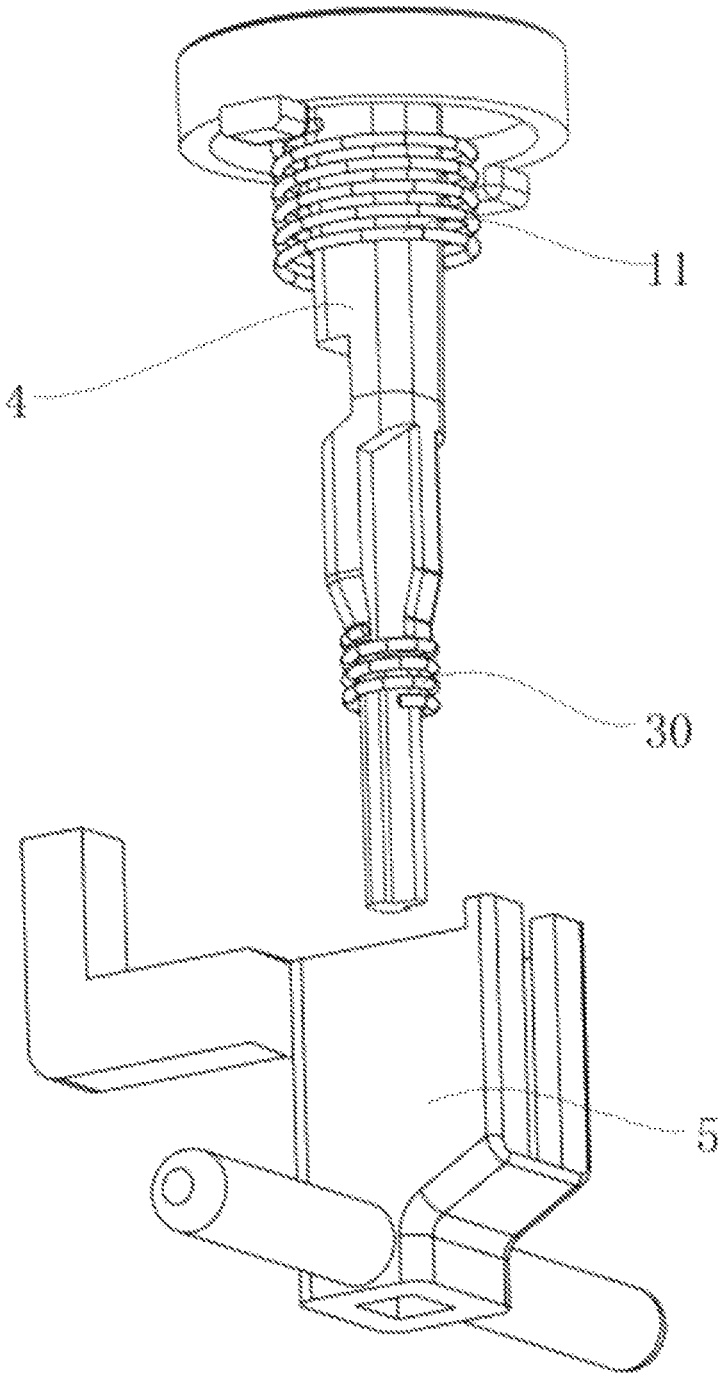
FIG. 12 illustrates a structural diagram in which an auxiliary tripping spring is sleeved on a key bar in the present invention.

As shown in FIG. 6 and FIG. 7, compared to embodiment 2, in this embodiment, the bottom of the reset key 4 is provided with an auxiliary tripping spring 30. Specifically, the auxiliary tripping spring 30 is arranged in the return rotation stopper 5 with one end of the auxiliary tripping spring being abutted against the bottom of the key bar 10, or the auxiliary tripping spring 30 is disposed on the key bar 10 in a sleeving manner, as shown in FIG. 12. Through the arrangement of the auxiliary tripping spring 30, when the electromagnetic driven device is in a power-off state, the auxiliary tripping spring 30 can provide downward force for a return rotation stopper 5, and the return rotation stopper 5 can move downward under the elastic force of the auxiliary tripping spring 30, so as to ensure that the elastic piece moves downward and is separated from a conducting terminal and is therefore powered off.

Embodiment 5

Figure 10:
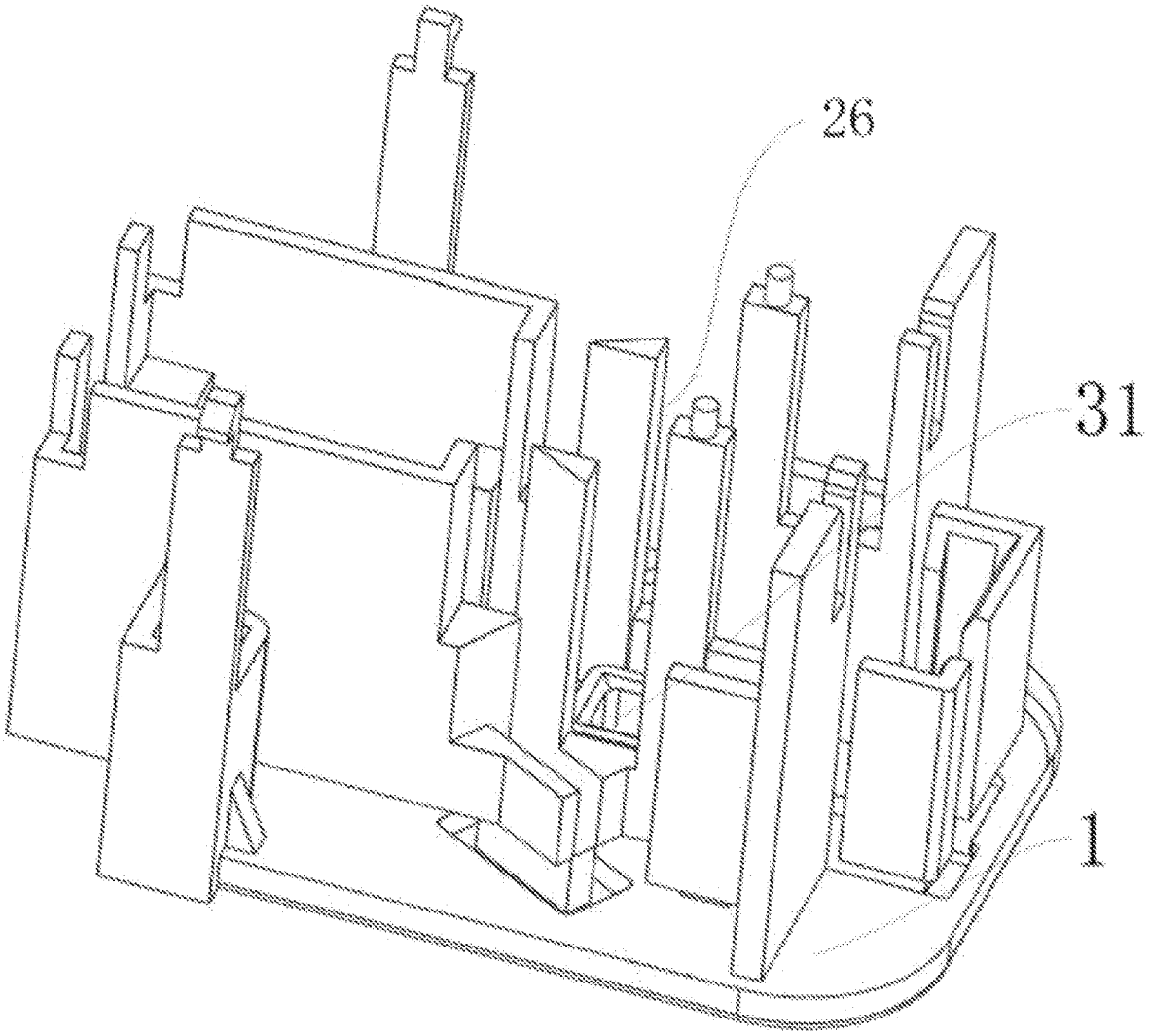
FIG. 10 illustrates a structural diagram of a base in which the ground wire elastic piece does not exist in the present invention.

Compared with embodiment 1, in this embodiment, as shown in FIG. 10, the bottom of the reset key 4 passes through the return rotation stopper 5, and a jack 31 corresponding to the bottom of the reset key 4 is provided in the base 1. The reset key 4 is limited by the upper cover 3 and the jack 31 in the base 1 at the same time, which can make the reset key 4 more stable when moving up and down, and it will not happen that the reset key 4 will shake when only limited by the upper cover 3.

Embodiment 6

Figure 3:
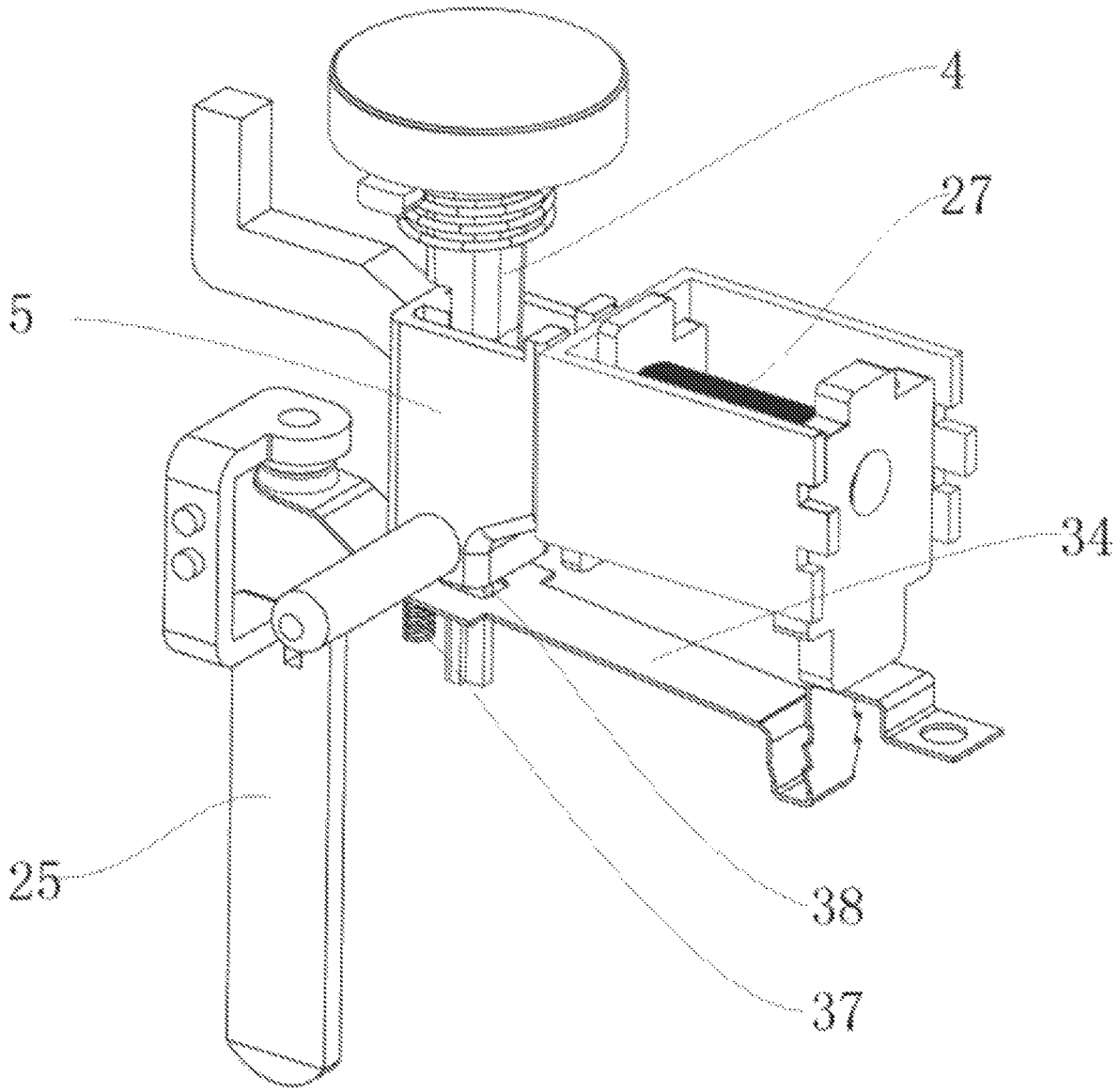
FIG. 3 illustrates a perspective diagram of an internal structure of the leakage protector in the present invention.

Compared with embodiment 2, in this embodiment, as shown in FIG. 3, the bottom of the reset key 4 passes through the return rotation stopper 5 and the ground wire elastic piece 34, and the jack 31 corresponding to the bottom of the reset key 4 is provided in the base 1. The reset key 4 is limited by the upper cover 3 and the jack 31 in the base 1 at the same time, which can make the reset key 4 more stable when moving up and down, and it will not happen that the reset key 4 will shake when only limited by the upper cover 3.

In this embodiment, the ground wire elastic piece 34 is provided with an elastic piece hole 38 corresponding to the bottom of the reset key 4, and the bottom of the reset key 4 passes through the elastic piece hole 38.

Embodiment 7

Compared with embodiment 2, in this embodiment, an auxiliary ground return spring 37 is further provided between the ground wire elastic piece 34 and the base 1. The auxiliary ground return spring 37 can generate upward elastic force on the ground wire elastic piece 34. The auxiliary ground return spring 37 can effectively ensure the connection between the ground wire pin 25 and the ground wire elastic piece 34.

Embodiment 8

Figure 11:
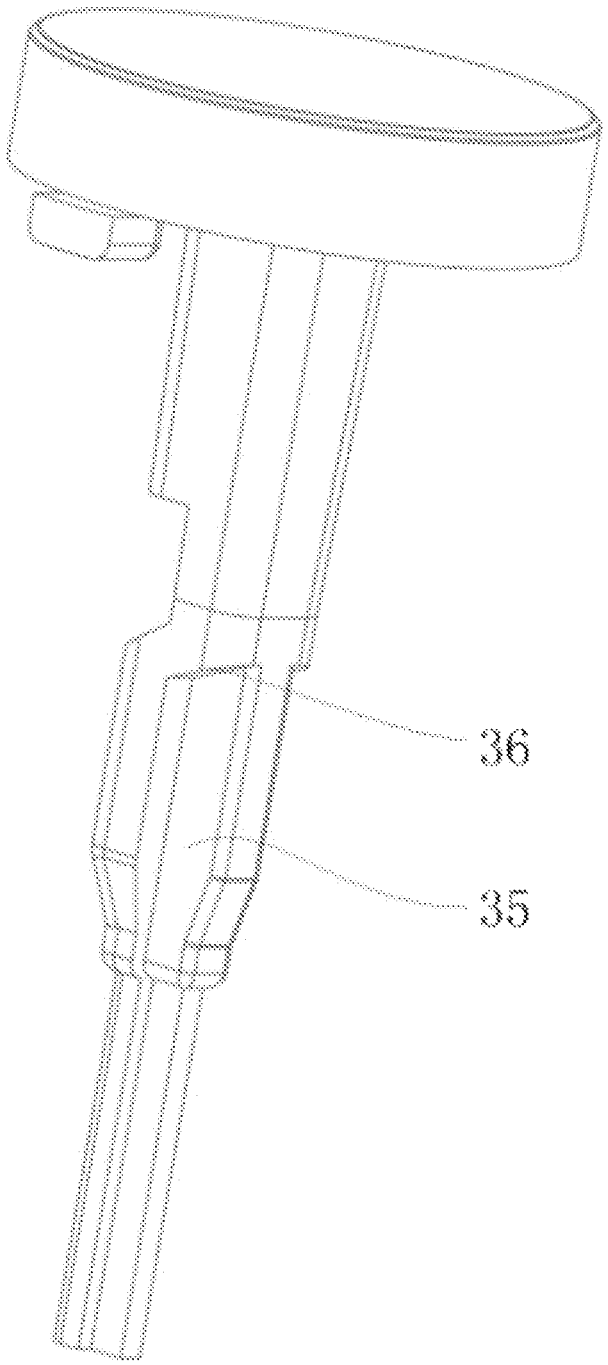
FIG. 11 illustrates a structural diagram of a reset key in the present invention.

Compared with embodiment 1, in this embodiment, as shown in FIG. 11, a side part of the reset key 4 is further provided with a return sliding groove 35, and the return rotation stopper 5 is further provided with a sliding guide post 29, wherein the return sliding groove 35 and the sliding guide post 29 can be corresponded to and cooperated with each other. The return sliding groove 35 is symmetrically disposed on both sides of the key bar 10, and the return sliding groove 35 is set upwards from the lower end of the key bar 10, and the sliding guide post 29 is used to be cooperate with the up and down movement of the key bar 10. An upper part of the return sliding groove 35 is provided with a sliding groove transition inclined surface 36. When the reset key 4 is pressed down, the sliding guide post 29 can firstly be cooperated with the return sliding groove 35 to slide. As the reset key 4 continues to be pressed down, the sliding guide post 29 slides out of the return sliding groove 35. Specifically, the sliding guide post 29 is slid out along the sliding groove transition inclined surface 36 and is abutted against a side surface of the key bar 10 where the sliding groove is not provided. Through this abutment, the return rotation stopper 5 can rotate at a certain angle towards the side of electromagnetic driven device 6. This preparatory action can effectively reduce the power requirement of an electromagnetic coil on the electromagnetic driven device 6. At this time, if the electromagnetic driven device 6 is powered on, it can ensure that the reset rotation block 5 is tightened by the driven iron core 23, so that the entire leakage protector maintains in the power-on state.

The above are only the preferred embodiments of the present invention. It should be pointed out that for those of ordinary skill in the art, without departing from the technical principles of the present invention, several improvements and modifications can be made, which should also be regarded as the protection scope of the present invention.

What is claimed is:

1. A rotary maintenance type leakage protector, comprising:

a base;

a leakage protection device, wherein the leakage protection device comprises a reset key, a return rotation stopper, an electromagnetic driven device and an elastic piece; and an upper cover, wherein the base is further provided with a conducting terminal that is electrically connected with the elastic piece;

wherein the return rotation stopper is mounted on an upper part of the base and is configured to move up and down, and two sides of the return rotation stoppers are provided with protruding ends that can be abutted against the elastic piece; the electromagnetic driven device is disposed on a side of the upper part of the base, and the electromagnetic driven device is provided with a driven iron core, the driven iron core is protruded from the electromagnetic driven device and is movably clamped to a side wall of the return rotation stopper, and the electromagnetic driven device is able to drive the driven iron core to move so as to drive the return rotation stopper to rotate;

the return rotation stopper is provided with a buckle block, and the reset key is sleeved with a return spring, one end of the return spring is abutted against an upper part of the upper cover, the other end of the return spring is abutted against the reset key; the reset key passes through the upper cover and is inserted into the return rotation stopper;

the electromagnetic driven device in a continuous power-on state is configured to enable the driven iron core to continuously tighten the return rotation stopper, and enable the buckle block to be continuously clamped to the reset key, so as to drive the return rotation stopper to move synchronously, and the reset key is configured to enable a power-on state in which the elastic piece is in contact with the conducting terminal through the return rotation stopper;

after the electromagnetic driven device in the continuous power-on state is powered off, the driven iron core releases the return rotation stopper, the buckle block and the reset key are out of a clamped state, and, the elastic piece is separated from the conducting terminal under an elastic force action of the elastic piece and is therefore powered off.

2. The rotary maintenance type leakage protector as claimed in claim 1, wherein the reset key is provided with a bayonet in clamping fit with the buckle block, and the bayonet is provided with an upper clamping surface and a lower tripping inclined surface.

3. The rotary maintenance type leakage protector as claimed in claim 2, wherein an opening groove is provided on a side wall, close to the driven iron core, of the return rotation stopper, the buckle block is provided on a side wall, opposite to the opening groove, of the return rotation stopper, and the opening groove is used for being clamped to the driven iron core.

4. The rotary maintenance type leakage protector as claimed in claim 1, wherein a top of the base is provided with a sliding groove which can enable the return rotation stopper to be inserted and installed up down into the base, the return rotation stopper is movable up and down relative to the sliding groove, and the return rotation stopper is rotatable in the sliding groove with the protruding ends as an axis.

5. The rotary maintenance type leakage protector as claimed in claim 2, wherein after the electromagnetic driven device is powered off, the driven iron core releases the return rotation stopper, the reset key moves upwards under an action of the return spring; during an upward movement of the reset key, the return rotation stopper slides out of the lower tripping inclined surface of the reset key and breaks away from a clamped state with regard to the reset key.

6. The rotary maintenance type leakage protector as claimed in claim 1, wherein the conducting terminal has a pin structure, wherein the pin structure comprises a neutral wire pin, a live wire pin and a ground wire pin, the elastic piece comprises a neutral wire elastic piece and a live wire elastic piece, a position of the neutral wire pin is corresponded to a position of the neutral wire elastic piece, a position of the live wire pin is corresponded to a position of the live wire elastic piece, and the ground wire pin is directly connected with a ground wire; two protruding ends are provided at lower parts of the neutral wire elastic piece and the live wire elastic piece, the neutral wire elastic piece and the live wire elastic piece automatically move downwards under action of their own elastic force.

7. The rotary maintenance type leakage protector as claimed in claim 1, wherein the conducting terminal has a pin structure, comprising a neutral wire pin, a live wire pin and a ground wire pin, the elastic piece comprises a neutral wire elastic piece, a live wire elastic piece and a ground wire elastic piece; a position of the neutral wire pin is corresponded to a position of the neutral wire elastic piece, a position of the live wire pin is corresponded to a position of the live wire elastic piece, and a position of the ground wire pin is corresponded to a position of the ground wire elastic piece; two protruding ends are disposed at lower parts of the neutral wire elastic piece and the live wire elastic piece, and the neutral wire elastic piece and the live wire elastic piece both automatically move downward under action of their own elastic force; a bottom of the return rotation stopper is provided with a ground wire protruding end, and the ground wire protruding end is provided on a top of the ground wire elastic piece for controlling the ground wire elastic piece to move downward; the ground wire elastic piece automatically moves upward under an action of its own elastic force.

8. The rotary maintenance type leakage protector as claimed in claim 1, wherein the leakage protection device further comprises a compression guide block disposed on a side of the upper part of the base by clamping, and the compression guide block is provided with a compression end for compressing and fixing the conducting terminal on the base.

9. The rotary maintenance type leakage protector as claimed in claim 1, wherein the conducting terminal and the elastic piece are embedded in the base, and both the conducting terminal and the elastic piece are provided with corresponding conducting contacts; an end of the return rotation stopper is further provided with an indicator rod that is protruded, the indicator rod is able to rotate with the return rotation stopper so as to display a status of the leakage protector.

10. The rotary maintenance type leakage protector as claimed in claim 1, wherein a bottom of the reset key is further provided with an auxiliary tripping spring.

11. The rotary maintenance type leakage protector as claimed in claim 6, wherein a bottom of the reset key passes through the return rotation stopper, and the base is provided with a jack corresponding to the bottom of the reset key.

12. The rotary maintenance type leakage protector as claimed in claim 7, wherein a bottom of the reset key passes through the return rotation stopper and the ground wire elastic piece; the base is provided with a jack corresponding to the bottom of the reset key.

13. The rotary maintenance type leakage protector as claimed in claim 8, wherein an auxiliary ground wire return spring is provided between the ground wire elastic piece and the base.

14. The rotary maintenance type leakage protector as claimed in claim 7, wherein the ground wire protruding end is configured to enable the neutral wire elastic piece and the live wire elastic piece to be disconnected prior to the ground wire elastic piece.

15. The rotary maintenance type leakage protector as claimed in claim 1, wherein a side part of the reset key is further provided with a return sliding groove, and the return rotation stopper is further provided with a sliding guide post, and the return sliding groove is correspondingly engaged with the sliding guide post.

16. The rotary maintenance type leakage protector as claimed in claim 15, wherein an upper part of the return sliding groove is provided with a sliding groove transition inclined surface, and during a compression of the reset key, the sliding guide post firstly slides in cooperation with the return groove, and then slides out of the sliding groove transition inclined surface and is abutted against a side surface of the reset key, so that the return rotation stopper rotates towards a side of the electromagnetic driven device.

* * * * *